United States Patent [19]

Anhalt et al.

[11] Patent Number: 4,624,517

[45] Date of Patent: Nov. 25, 1986

[54] LOW INSERTION FORCE CONNECTOR SYSTEM

[75] Inventors: John W. Anhalt, Orange; David S. Goodman, Mission Viejo, both of Calif.

[73] Assignee: ITT Corporation, New York, N.Y.

[21] Appl. No.: 718,420

[22] Filed: Apr. 1, 1985

[51] Int. Cl.[4] ..... H01R 13/629

[52] U.S. Cl. ..... 339/75 M; 339/14 P

[58] Field of Search ..... 339/74 R, 75 M, 14 P

[56] References Cited

U.S. PATENT DOCUMENTS

| | | | |
|---|---|---|---|
| 3,489,986 | 1/1970 | Frederick | 339/75 M |
| 3,594,698 | 7/1971 | Anhalt | 339/176 M |
| 3,950,059 | 4/1976 | Anhalt et al. | 339/75 M |
| 4,018,492 | 4/1977 | Eckart | 339/14 P |
| 4,026,623 | 5/1977 | Goodman et al. | 339/75 M |
| 4,094,570 | 6/1978 | de Barros | 339/75 M |

*Primary Examiner*—John McQuade

*Attorney, Agent, or Firm*—T. L. Peterson; R. C. Turner

[57] ABSTRACT

An improvement is described in a low insertion force connector system wherein an insertable circuit assembly is inserted into a housing against an inplace circuit assembly, with the terminals adjacent but out of contact, at which time a cam is actuated to move a device that deflects one set of terminals against the other. In the present system, the cam includes a portion that deflects against an auxillary terminal to make contact with it before the main terminals are in contact.

4 Claims, 4 Drawing Figures

LOW INSERTION FORCE CONNECTOR SYSTEM

BACKGROUND OF THE INVENTION

One type of connector system, often designated as a low insertion force system, includes a pair of connectors having terminals that do not make contact as the connectors are brought against one another. After the connectors are brought together, a cam is actuated to deflect one set of terminals against the other. U.S. Pat. No. 3,594,698 by Anhalt entitled LOW INSERTION FORCE CONNECTOR ASSEMBLY, describes a system of this type.

In certain applications, it is desirable to provide first make-last break terminals, as to assure that certain portions of both connectors are at the same ground potential before the rest of the terminals make contact, and to maintain such contact until all other terminals have broken contact. In conventional pin-socket type connectors this has been accomplished by making one terminal longer than the others to make contact first and break contact last. However, in the low insertion force system all contacts are of the same length. A simple and reliable arrangement for bringing a pair of auxillary terminals into contact before the othersand keeping them in contact as the others break contact, in a low insertion force connector system, would increase the utility of such connector systems.

SUMMARY OF THE INVENTION

In accordance with one embodiment of the present invention, a low insertion force connector system is described, which has a relatively simple and rugged additional means for providing a first make-last break terminal pair. The cam which deflects the main terminals of one connector against those of the other, also carries an auxilliary terminal that contacts a corresponding auxilliary terminal on one of the connectors, to make contact as the cam moves relative to the connectors to deflect a set of main terminals.

The novel features of the invention are set forth with particularity in the appended claims. The invention will be best understood from the following description when read in conjunction with the accompanying drawings.

DESCRIPTION OF THE PREFERRED EMBODIMENTS

Figure 1A:
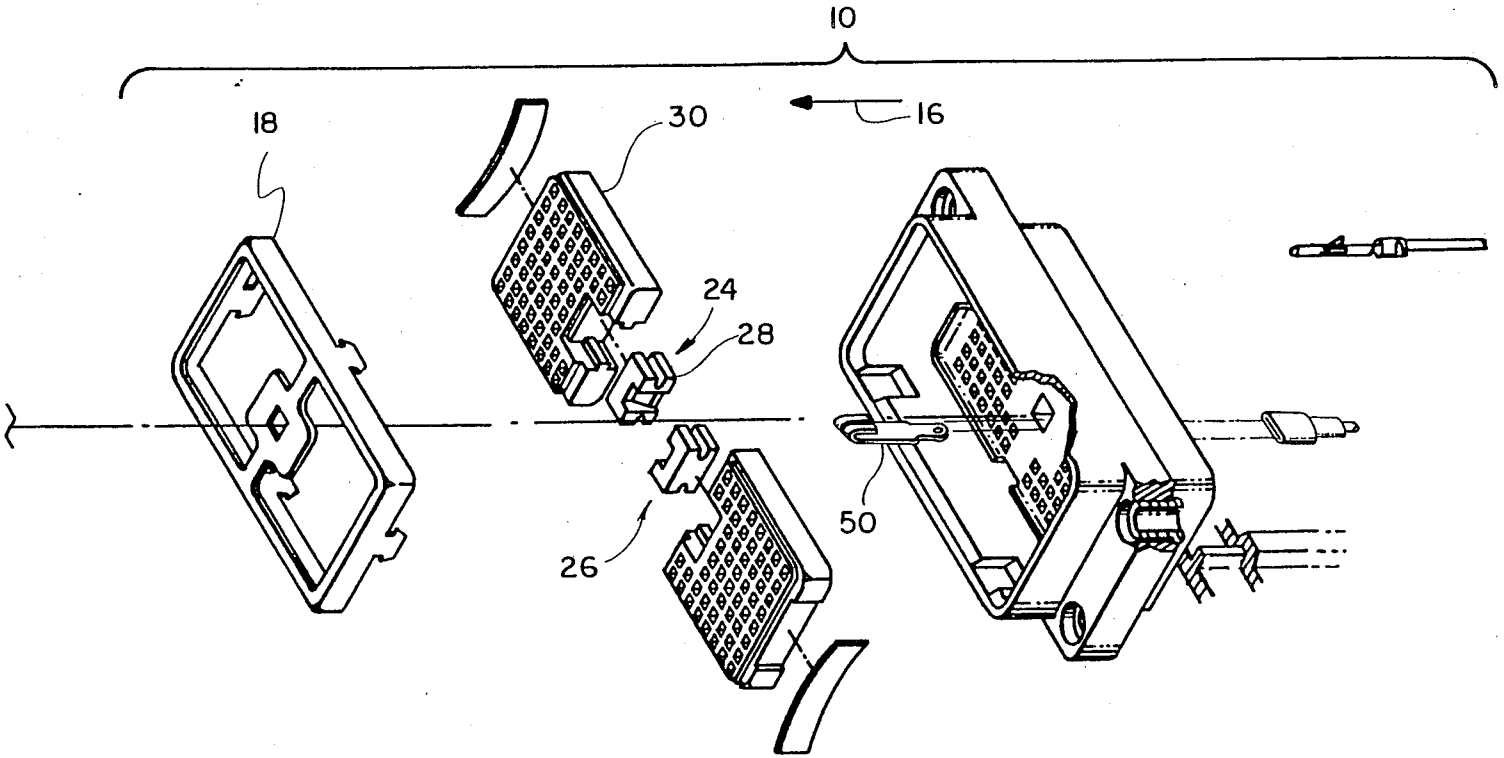
FIG. 1 is an exploded perspective view of an insertable circuit assembly of a connector system constructed in accordance with one embodiment of the present invention.
FIG. 1B is an exploded perspective view of an inplace circuit assembly of the circuit connection system constructed in accordance with one embodiment of the present invention.
Figure 1B:
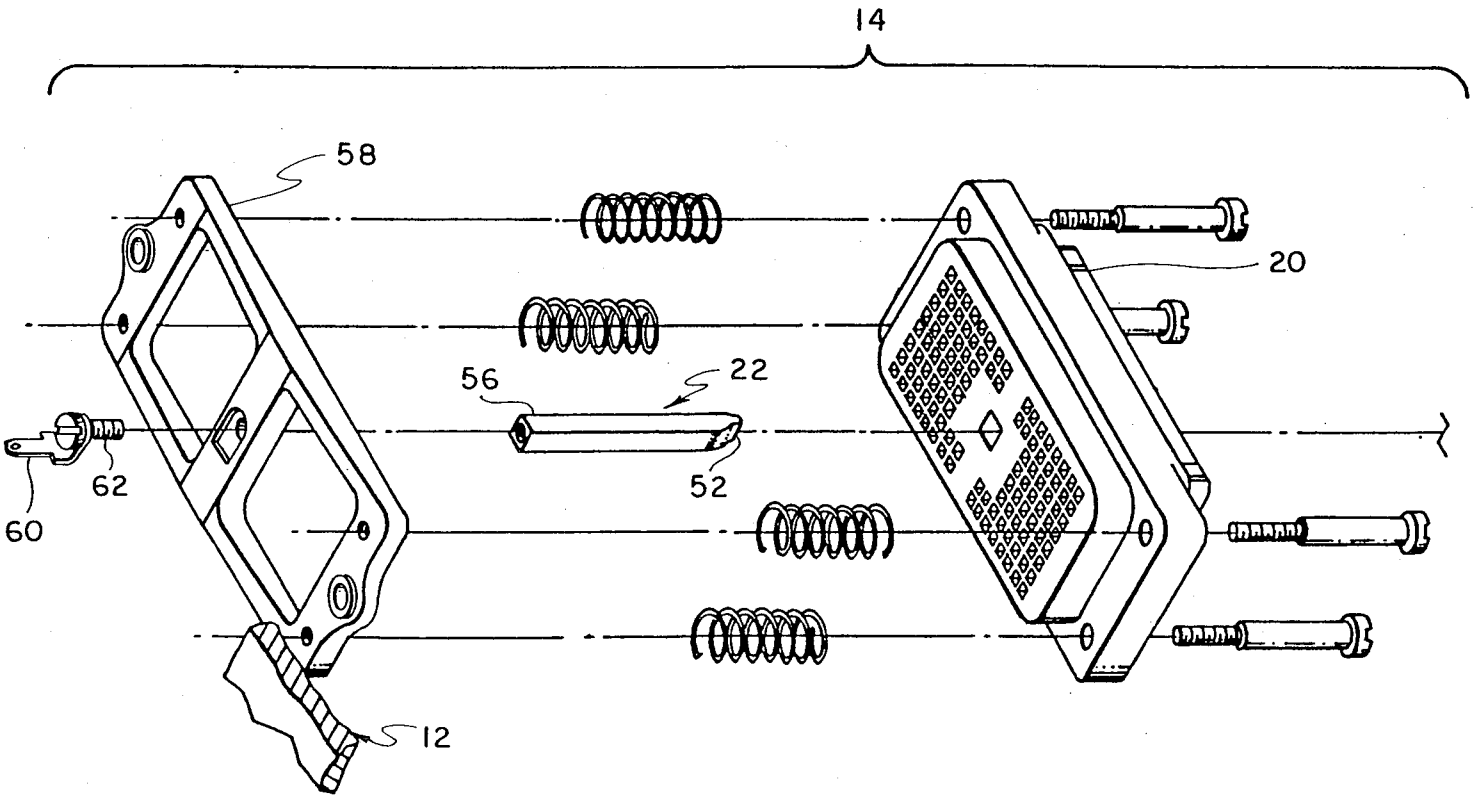

FIGS. 1A and 1B illustrate a system which includes an insertable or insertion assembly 10 that can be inserted into a housing 12 to connect to an inplace circuit assembly 14 that normally always lies within the housing. During movement of the insertable assembly in an insertion direction 16, an abutting surface 18 of the insertable assembly abuts a corresponding abutting surface 20 on the inplace assembly. Contact of the main terminals of the two assemblies is accomplished by pushing the insertable assembly even further into the housing, so it pushes the inplace assembly 14 along with it. Such further pushing results in a cam device 22 that is fixed to the housing, more fully engaging a pair of deflection devices 24, 26, each deflecting device including a cam follower 28 and a deflecting member 30 slideably mounted on an insertable assembly frame 31.

Figure 2:
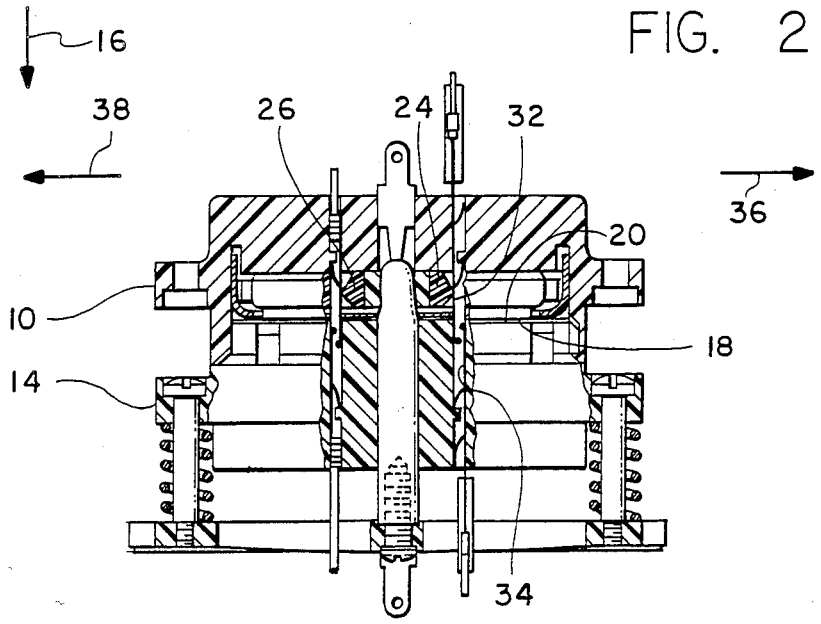
FIG. 2 is a sectional view of the connector system of FIGS. 1A and 1B shown prior to full engagement of the terminals.
Figure 3:
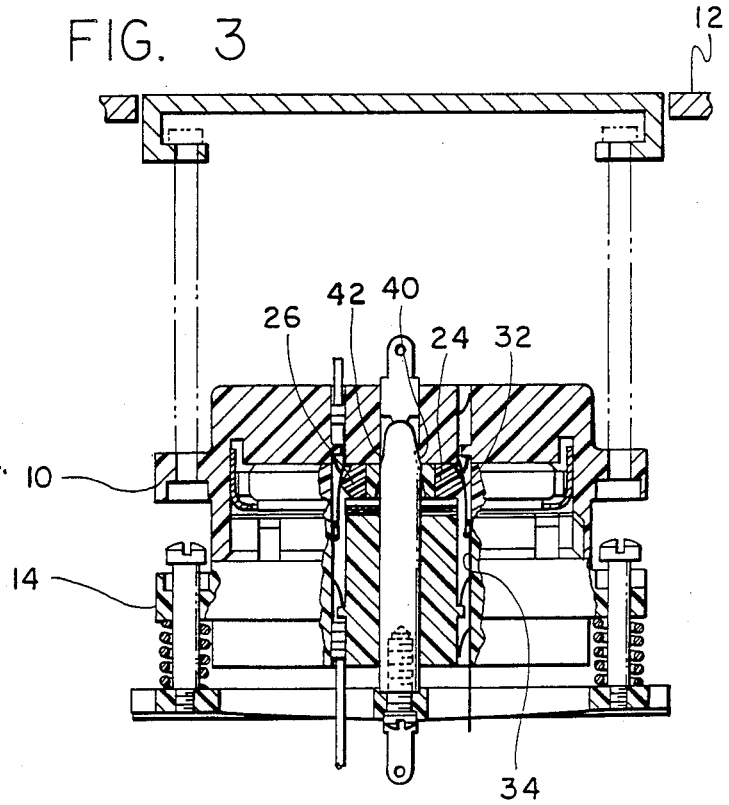
FIG. 3 is a view similar to that of FIG. 2, but showing the system after full engagement of the terminals.

FIG. 2 illustrates the system at a time when the insertable assembly 10 has been inserted just far enough for the abuttable surfaces 18, 20 to engage one another. It can be seen that the outer end portions of the multiple main terminals 32 of the insertable assembly lie adjacent and opposite the outer end portions of the main terminals 34 of the inplace assembly. The cam device has reached the deflecting devices 24, 26, but has not deflected them along opposite lateral directions 36, 38. Accordingly the terminals have not been deflected against one another. Further movement of the insertable assembly 10 in the insertion direction 16, to push it and the inplace assembly in, results in the assemblies 10, 14 moving to the fully inserted position shown in FIG. 3. In that position, camming surfaces 40, 42 on the cam device have pushed the deflecting devices 24, 26 so they deflect the free ends of the main terminals 32 against the main terminals 34 of the inplace assembly.

In accordance with the present invention, a pair of auxillary terminals 50 (FIG. 1A) and (FIG. 1B) are provided that make contact prior to the making of contact of the main terminals 32, 34 during the full insertion of the insertable assembly, and that break contact after the breaking of contact of the main terminals 32, 34 during withdrawal of the inplace assembly in a direction opposite to the insertion direction 16. One auxillary terminal 52 is formed by the outer end portion of the cam device 22. The inner end 56 of the cam device is fixed to a plate 58 that is part of the housing 12. A axilliary conductor 60 is connected to the cam device by a suitable fastener 62. The cam device 22 can be formed of a metal rod so that current can flow through its outer end which forms the auxilliary contact 52. The other auxilliary terminal 50 is mounted on the insertableframe and is an easily deflectable terminal which lies in the path of the cam device to contact it and begin deflecting perpendicular to the insertion direction prior to the cam device moving the deflecting devices far enough to move the main terminals into contact with each other.

The fact that one of the auxilliary terminals 52 is formed by a portion of the cam device 22, results in the provision of an auxilliary terminal with little additional cost of constructing the inplace assembly, and also results in the auxillary terminal 52 being rugged and therefore reliable. However, a separate auxilliary contact can be carried by the cam of the cam device. The other auxilliary terminal 50 on the insertable assembly lies within the boundaries of the frame 31 of the insertable assembly, so that the auxillary contact 50 on the insertable assembly is protected from damage during normal handling.

Thus, the invention provides a low insertion connector system which includes first make-last break auxilliary terminals which are brought in contact by the same motion of a cam used to deflect one set of main terminals against a set of other main terminals. In one system, this is accomplished by using a portion of a cam device to contact an auxilliary terminal during the movement of the auxilliary terminal towards the cam device in the process of moving abutting connector assemblies in an insertion direction.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a connector system for making contact between terminals of an inplace assembly that lies within a housing and terminals of an insertable assembly that can slide in an insertion direction into and in an opposite direction out of the housing, wherein most of the terminals on one assembly are main terminals to be deflected sidewardly after they lie opposite corresponding main terminals on the other assembly, and wherein each assembly has a first make/last break auxilliary terminal that makes contact prior to the making and breaks contact after the breaking of the main terminals, the improvement wherein:

said insertable assembly includes a deflection device which is movable largely perpendicular to said insertion direction to deflect a plurality of main terminals sidewardly, and said deflection device including a cam follower;

said housing includes a cam device having an end positioned to engage said cam follower of said deflection device to move said deflection device sidewardly as the insertable assembly moves in said insertion direction;

said cam device includes a first of said auxilliary terminals, and the other second one of said auxiliary terminals is mounted on the insertable assembly at a location to engage the first auxilliary terminal prior to movement of said deflection member far enough to deflect the main terminals against other main terminals.

2. The improvement described in claim 1 wherein:

said cam device is formed of metal and its end forms said first auxilliary terminal.

3. The improvment described in claim 1 wherein:

said insertable assembly includes an insertion frame on which its main terminals are mounted, said second auxilliary terminal has an inner end mounted on said insertion frame and a deflectable outer end lying in the path of said first auxilliary terminal, said deflectable outer end being positioned to engage said first auxilliary terminal prior to said cam device deflecting said cam follower far enough to move the main terminals into contact with each other, and said second auxilliary terminal being deflectable perpendicular to said insertion direction as it and the insertion frame move further in the insertion direction during engagement with the cam device.

4. A connector system comprising:

a housing;

an inplace assembly lying within said housing and moveable a limited distance along an insertion direction therein, said inplace assembly including a plurality of inplace main terminals;

an insertion assembly moveable into said housing to abut said inplace assembly, said insertion assembly having a plurality of insertion main terminals which lie opposite the inplace main terminals when the assemblies abut one another, said insertion assembly also including a deflecting device which can move in a second direction largely perpendicular to said insertion direction to deflect said insertion main terminals against the inplace main terminals;

said insertion assembly also including an insertion auxilliary terminal;

an auxilliary electrical conductor on said housing; and a cam mounted on said housing and having a metal outer end, said metal outer end electrically coupled to said auxilliary conductor;

said cam positioned so its outer end engages said deflecting device to move it in said second direction, and engages said insertion auxilliary terminal to make contact with it, as said insertion assembly moves in said insertion direction.

* * * * *